US006205760B1

(12) United States Patent
Pellicciotti et al.

(10) Patent No.: US 6,205,760 B1
(45) Date of Patent: Mar. 27, 2001

(54) TWISTED PAIR EXCHANGE CABLE MANUFACTURING PROCESS AND APPARATUS

(75) Inventors: Gabe Pellicciotti, Phoenix; James A. Haas, Scottsdale; Mark Bernhardt, Phoenix; Robert Goodridge, Queen Creek; William Dawson, Phoenix, all of AZ (US)

(73) Assignee: Belden Communications Company, Phoenix, AZ (US)

( * ) Notice: Subject to any disclaimer, the term of this patent is extended or adjusted under 35 U.S.C. 154(b) by 0 days.

(21) Appl. No.: 09/344,033

(22) Filed: Jun. 25, 1999

(51) Int. Cl.[7] ..... D01H 13/26
(52) U.S. Cl. ..... 57/314; 57/6; 57/16; 57/112
(58) Field of Search ..... 57/314, 14, 112, 57/362, 17, 16, 18, 6, 12, 13; 174/112

(56) References Cited

U.S. PATENT DOCUMENTS

| | | | | |
|---|---|---|---|---|
| 1,667,824 | | 5/1928 | Richey . | |
| 1,727,955 | | 9/1929 | Biggar . | |
| 1,752,497 | | 4/1930 | Massingham . | |
| 1,856,676 | | 5/1932 | Weston . | |
| 1,956,730 | * | 5/1934 | Reichelt | 57/3 |
| 2,412,196 | * | 12/1946 | Ashbaugh et al. | 57/58.36 |
| 2,882,676 | * | 4/1959 | Bryan et al. | 57/14 X |
| 3,020,335 | | 2/1962 | Gillis . | |
| 3,031,524 | | 4/1962 | Hicks . | |
| 3,319,412 | | 5/1967 | Winter et al. . | |
| 3,651,629 | | 3/1972 | Webster . | |
| 4,128,736 | | 12/1978 | Nutt et al. . | |
| 4,359,860 | * | 11/1982 | Schleese et al. | 57/14 X |
| 4,385,485 | | 5/1983 | Yonechi . | |
| 4,528,420 | | 7/1985 | Kish et al. . | |
| 4,530,205 | | 7/1985 | Seiler et al. . | |
| 4,577,403 | * | 3/1986 | Garner | 57/314 X |
| 4,813,223 | | 3/1989 | Nipper et al. . | |
| 5,665,293 | | 9/1997 | Celoudoux et al. . | |

FOREIGN PATENT DOCUMENTS

WO 97/17260 5/1997 (DE) .

* cited by examiner

*Primary Examiner*—Rodney M. Lindsey
(74) *Attorney, Agent, or Firm*—Snell & Wilmer L.L.P.

(57) ABSTRACT

An improved manufacturing process for twisted pair exchange cables and for an improved binding machine used during this manufacturing process is provided. The manufacturing process includes a stranding phase and a cabling phase. During the stranding phase, unit cables are produced with only a first colored ribbon to identify them. During the cabling phase, a second colored ribbon that identifies the orientation of the unit within the cable is applied. This will result in units that have one of two colors (e.g., yellow or black). The improved binding machine is used to apply the second colored ribbon.

20 Claims, 7 Drawing Sheets

TWISTED PAIR EXCHANGE CABLE MANUFACTURING PROCESS AND APPARATUS

BACKGROUND OF THE INVENTION

1. Field of the Invention

The present invention generally relates to twisted pair exchange cables, and, more particularly, to an improved process and apparatus for producing twisted pair exchange communication cables.

2. Description of the Related Art

Telecommunication networks commonly use twisted pair exchange cables to transmit voice and data signals between central offices and the individual end users. A twisted pair exchange cable comprises groups of individual conductor wires that are twisted together into pairs. A twisted pair exchange cable may have 50, 100, 1200, 2400 or any number of pairs contained in one cable.

For economy of manufacture, it has long been the practice to group a large number of conductor pairs into units within one cable; each unit typically contains 50, 100 or any convenient number of conductor pairs. To facilitate efficient manufacturing and installation, it is often necessary to identify a particular unit within the cable. For example, if the cable is accidentally severed and needs repairing, then the two parts of the cable may be restored by splicing together the corresponding twisted pairs. Splicing a cable requires the cable splicer to identify the corresponding units of conductor pairs within each part of the cable that is to be spliced. Complete color coding of each conductor pair within a telecommunications cable requires such a vast inventory of colors as to make complete color coding impractical. If each conductor pair had a unique color code, then the distinction between color shades of separate conductor pairs would be imperceptible to the human eye due to the large number of different colors that would be required. It is has therefore become standard practice in the industry to only uniquely color code conductor pairs within a unit. Thus, it is only necessary to uniquely color code units within a cable so that a cable technician can identify the corresponding units within each part of the cable that is to be spliced.

A color coding system for units within a cable is disclosed by Nutt et al., U.S. Pat. No. 4,128,736, issued Dec. 5, 1978. Nutt et al. disclose a mirror image coding system for 100 or 50 conductor pair units. Each unit is held together by two separately colored ribbons that serve to uniquely identify the unit based on its orientation within the cable. Hence, a cable technician can use the colored ribbons to identify two compatible units in separate pieces of cable for splicing. This color coding greatly simplifies the work of the cable tester, installer, splicer, and maintainer.

Current processes that are used to manufacture twisted pair exchange cables are generally divided into two phases: stranding and cabling. During the stranding phase, the unit is assembled from smaller sub unit components that contain a smaller number of conductor pairs. For example, a unit with one hundred conductor pairs may be constructed from four sub units that each have twenty five conductor pairs. When the four sub units are combined together to form the unit, they are twisted together and the two colored ribbons are applied. The two colored ribbons then serve to uniquely identify the unit. The units that are created during the stranding phase are stored on large spools which are referred to as unit trucks.

During the cabling phase, the final twisted pair exchange cable is constructed from the units produced by the stranding phase. This is accomplished by assembling the units together, in their proper orientation, to form the twisted pair exchange cable. The particular orientation of units within a given cable may be dictated by one or more cable standards. The output of the cabling phase will result in a twisted pair exchange cable that often has 1200 or more conductor pairs.

It is well known in the art that the two colored ribbons that serve to identify a unit are applied at the same time during the stranding phase. This will result in units that have different combinations of color ribbons. Hence, the different colored units need to be tracked separately from the stranding phase through the cabling phase.

Tracking the separate units adds complexity and cost to the manufacturing of twisted pair exchange cables. It adds complexity because there are numerous different color coded units that need to be tracked separately. These separate units need to be transported from the stranding machine to the machines used for the cabling phase. At the start of the cabling phase, each unit is loaded and strung so that it is in the correct orientation with respect to its color coding and the configuration of the twisted pair exchange cable that is to be produced. For a cable that requires 10–12 units or more, this is a time-consuming process that could take several hours. Thus, product changeover time can be quite long, since different twisted pair exchange cables often require different color combinations of units. Each time a different combination of units is required, the units that are the source for the cabling phase have to be changed. As stated above, this is a process that takes several hours. Thus, one shortcoming of the prior art is the lengthy product changeover time that is required when different twisted pair exchange cables are manufactured.

Since product changeover time is long, orders for small quantities of exchange cable (short orders) are expensive to fill. A short order is an order for a quantity of cable that is less than the amount of cable on a standard unit truck. A short order will entail changing the units that are used during the cabling phase, unless there is more than one short order with the exact same unit configuration. The units that are changed out will have to be tracked, and, if possible, used to fill other short orders. This rapidly adds complexity to the tracking of units, because the inventory of units will quickly build up with units of various lengths of cable. This often means that units are discarded without being fully used up, thus adding cost to the manufacturing of cables. Therefore, another shortcoming of the prior art is that the filling of short orders is expensive, and thus are not economically feasible to fill.

Another shortcoming is the complexity of the binding machines that are used to apply the colored ribbons to the units. Currently, it is well known in that art that there can be two spindles per drive belt of the binding machine. The spindles are used to apply the colored ribbons to the units of cable. Thus, for example, if eighteen spindles are desired to be used, then nine drive belts would be required. This creates complexity and makes maintenance of the machine more difficult which ultimately results in increased cost. Thus, it would be desirable to have a binding machine that allows for more spindles per drive belt which reduces the number of drive belts that are required. Another shortcoming of the binding machines of the prior art is that spur gears are often used to rotate the spindles. However, spur gear drives are noisy and expensive to maintain. Thus, it would also be desirable to have a cabling machine with a different mechanism for driving the spindles that is less costly to maintain.

SUMMARY OF THE INVENTION

Accordingly, there is a long-felt need for a simpler manufacturing process for twisted pair exchange cables and for an improved binding machine used during this manufacturing process. The present invention improves upon the prior art by providing for fewer units to track during the manufacture of a twisted pair exchange cable. This is accomplished by providing for an improved manufacturing process. The present invention also provides for an improved binding machine that is used to facilitate this improved manufacturing process. In accordance with one preferred embodiment, a method for producing a twisted pair exchange cable includes the steps of: applying a first identification-coded ribbon to a unit of a cable; collecting the initially identified unit on a unit truck; transporting the unit truck to a binding machine; and applying a second identification-coded ribbon to the initially identified unit at the binding machine.

BRIEF DESCRIPTION OF THE DRAWINGS

An exemplary embodiment of the present invention may best be understood by reference to the following description taken in conjunction with the claims and the accompanying drawings, in which like parts may be referred to by like numerals:

DETAILED DESCRIPTION

The subject matter of the present invention is particularly suited for use in connection with manufacturing twisted pair exchange cables. As a result, the preferred embodiment of the present invention is described in that context. It should be recognized, however, that the following description is not intended as a limitation on the use or applicability of the present invention, but is instead provided merely to enable a full and complete description of a preferred embodiment. On the contrary, various aspects of the present invention may be applied to a wide array of uses, e.g., any application that uses a coded binding technique for designating groups of wires, conductors, or the like.

Figure 1:
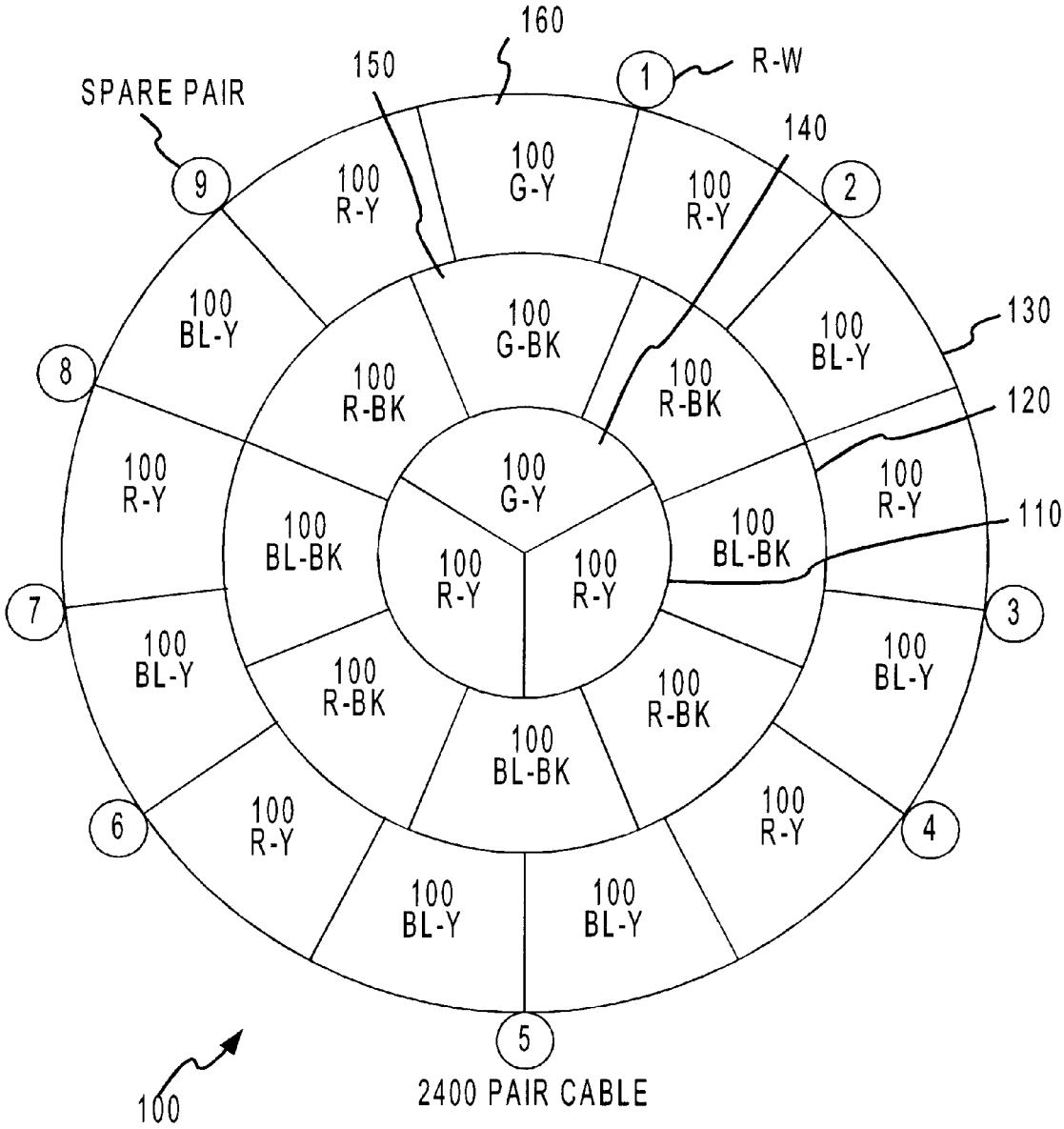
FIG. 1 is a cross-sectional view of the configuration of a 2400 pair cable.

Twisted pair exchange cables that are used in the telecommunications industry may comprise 50, 100, 1200, 1800, 2400, or any number of twisted pairs of conductor wires. FIG. 1 depicts one of many different layouts that may be associated with a 2400 pair cable. FIG. 1 is a schematic cross-sectional layout of an orientation of a twisted pair exchange cable 100 having 2400 conductor pairs. The cross-sectional layout shows the color coding of the units within the twisted pair exchange cable 100. In this example, the 2400 pair exchange cable has 24 units that each contain 100 conductor pairs. However, it should be noted that the present invention is not restricted to manufacturing a 2400 pair exchange cable with units of 100 pairs. A unit could consist of any number of twisted pairs of conductors.

Figure 5:
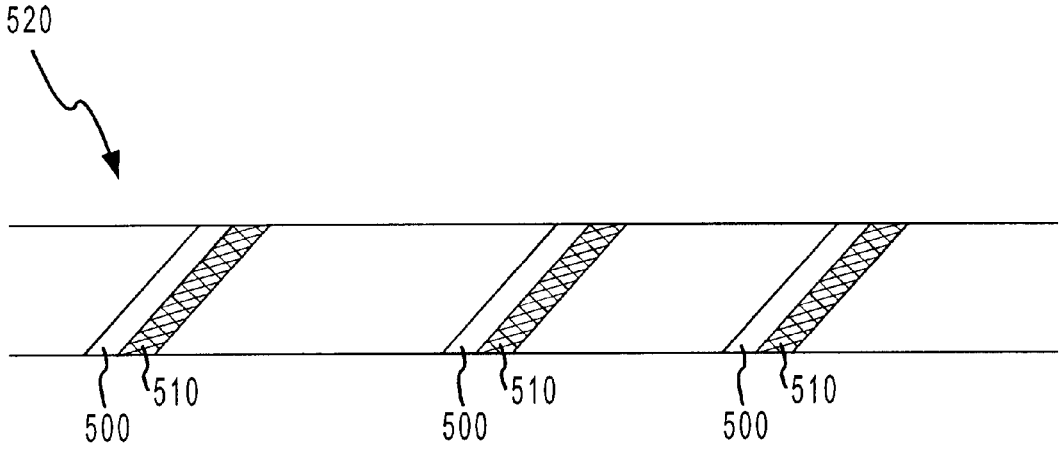
FIG. 5 illustrates a color coded unit.

The color coding illustrated in FIG. 1 is disclosed by Nutt et al., U.S. Pat. No. 4,128,736, issued Dec. 5, 1978; this arrangement is widely known to those skilled in the art. This color coding technique employs a mirror image scheme that results in a symmetrical layout of units within the cable. Each unit is held together by two colored ribbons that are wrapped around the unit in a spiral manner. Referring momentarily to FIG. 5, a unit 520 with two colored ribbons is illustrated. The first colored ribbon 500 and the second colored ribbon 510 are wrapped continuously around the unit in a spiral manner. The two ribbons are wrapped such that they are adjacent to each other.

Referring back to FIG. 1, the colors of the ribbons for each unit are indicated by the letter codes as follows: Y is yellow, BK is black, G is green, R is red, and BL is blue. The five different color ribbons are combined such that six possible combinations result: G-Y, R-Y, BL-Y, G-BK, R-BK, and BL-BK. The first colored ribbon (i.e., yellow or black) is used to define the layer of the unit within the twisted pair exchange cable. The units of the inner layer 110 are identified with yellow ribbons, the units of the middle layer 120 are identified with black ribbons, and the units of the outer layer 130 are identified with yellow ribbons.

The second colored ribbon (i.e., green, red, or blue) is used to identify the unit's position within the layer. Only one unit on each layer is identified with a green ribbon. Referring to FIG. 1, units 140, 150, and 160 are labeled with green ribbons. These units serve as the starting point for identifying other units on their respective levels. The units immediately adjacent to the green ribboned units are labeled with red ribbons. The remaining units on each layer are alternately labeled with blue and red ribbons. Thus, a color coding scheme is provided in the prior art that allows for identification of the units within a cable. However, it will be readily appreciated that the present invention is not limited to this color coding scheme.

The manufacturing process commonly used in the prior art is described above. The two colored ribbons that identify each unit are applied concurrently during the stranding phase. This results in six different color coded units that need to be tracked from the stranding phase through the cabling phase.

A preferred manufacturing process in accordance with the current invention may be used to create the exemplary cable described above. However, rather than having six different units on six different unit trucks, a reduced number of different color coded units (e.g., two) need to be tracked from the stranding phrase through the cabling phase. This allows for significant savings in time and money with the same twisted pair exchange cable produced employing the same color coding scheme as the prior art. It should be noted that the technique of the present invention may be utilized to produce any number of differently coded units; the following illustrative example may be employed to produce the same cable described above in connection with the prior art process.

Although color coding is preferably used as the identification scheme, the cable manufacturing process may use any suitable identification technique. For example, the ribbons may be printed with an alphanumeric code, a symbolic code or any other visible means of identification. Alternatively, the ribbons may contain tactile coding or texturing to enable one to identify the units by touch.

A manufacturing process in accordance with the current invention may be divided into two phases: the stranding phase, and the cabling phase. During the stranding phase, units are produced with a first colored ribbon to identify them. For example, the ribbon may be either black or yellow in the present example. A second colored ribbon that identifies the orientation of the unit within the cable is applied during the cabling phase. A preferred binding machine according to the current invention applies the second colored ribbon.

Figure 2:
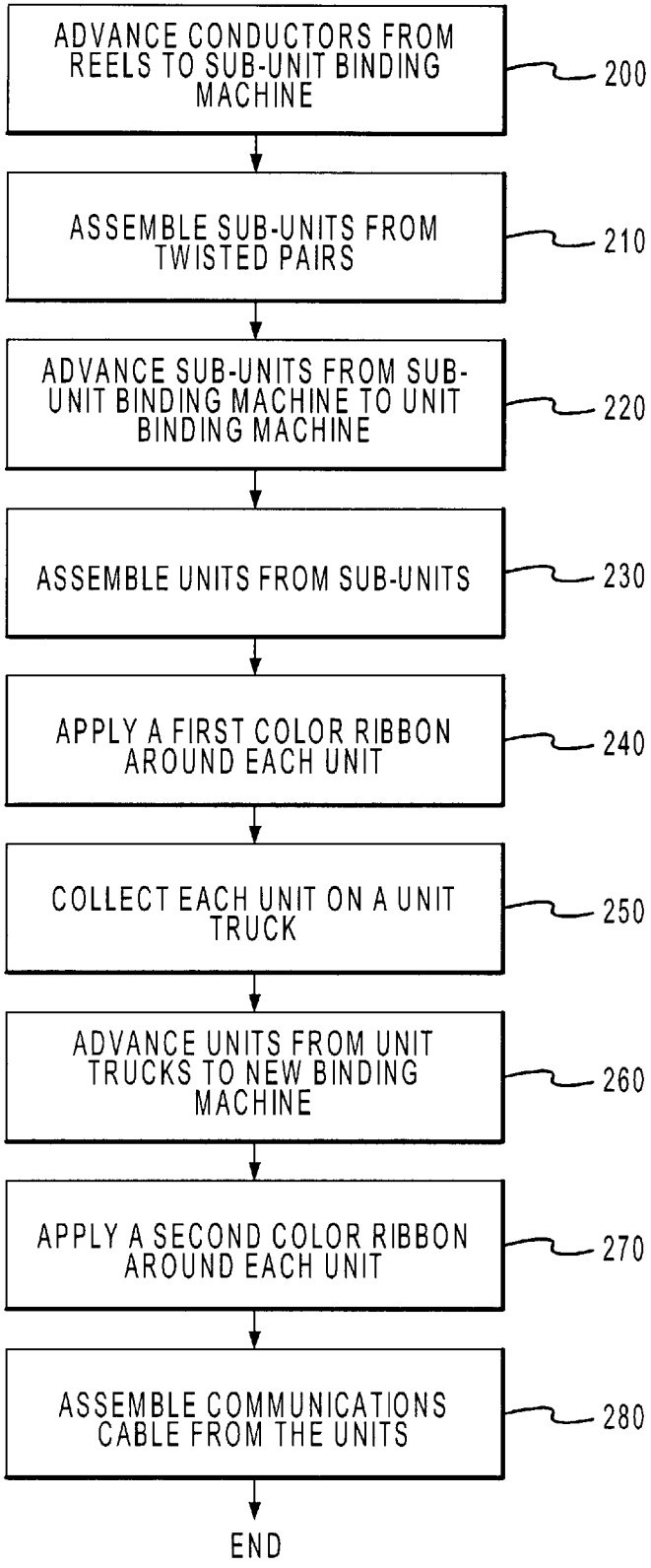
FIG. 2 illustrates a flow diagram according to an exemplary cable manufacturing process.
Figure 6:
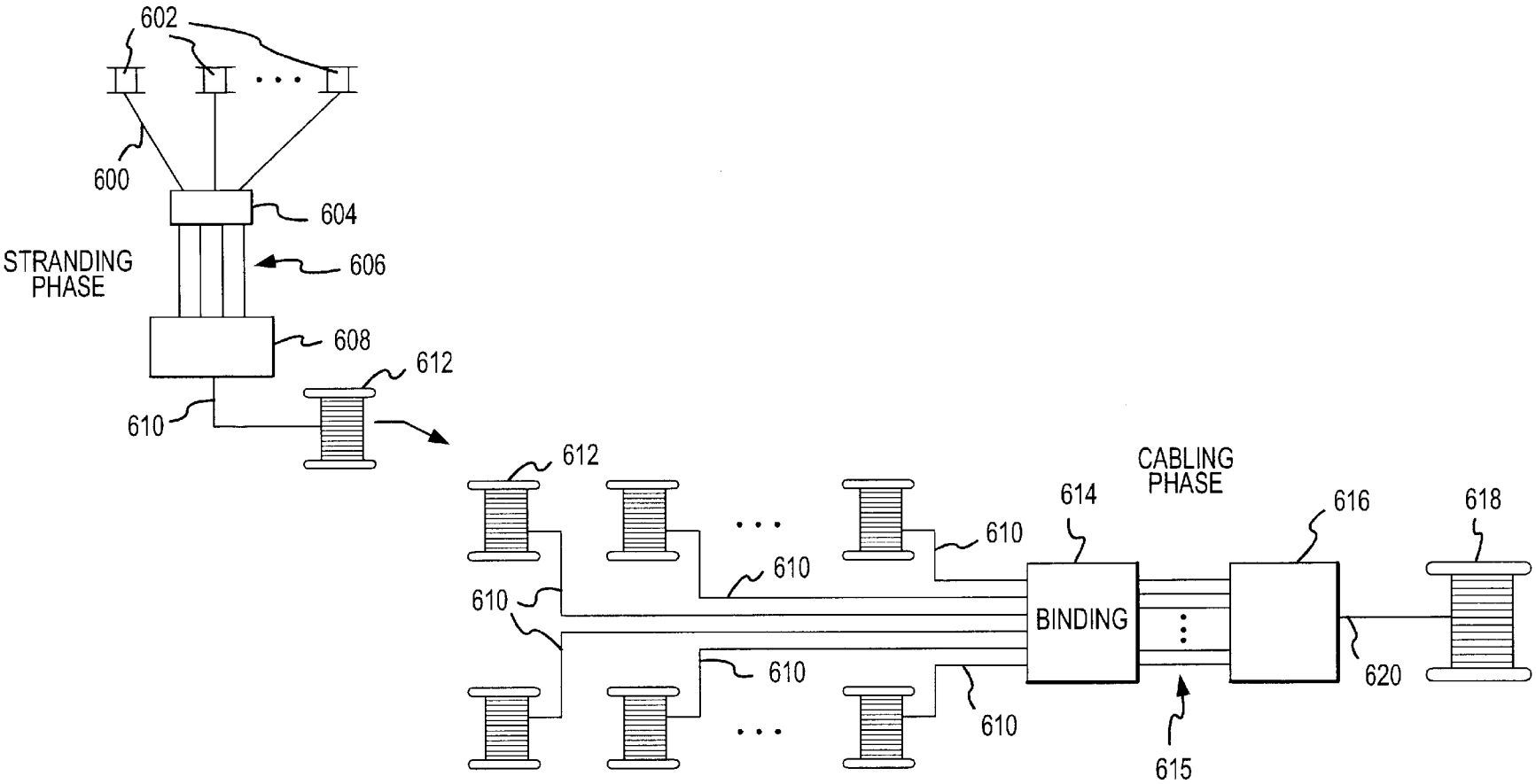
FIG. 6 is a block diagram schematic of an exemplary cable manufacturing system that may be used to perform the process shown in FIG. 2.

A factory floor where a twisted pair exchange cable is manufactured is typically laid out into two major areas; one area for the stranding phase and one area for the cabling phase. With reference to FIGS. 2 and 6, the stranding phase starts with a plurality of twisted conductor pairs 600 that are stored on reels 602. The conductors 600 are advanced from the reels 602 to a sub-unit binding machine 604 (step 200). At sub-unit binding machine 604, a suitable number of conductor pairs 600 are preferably twisted to form sub-units 606 (step 210). A sub-unit is a subset of a unit, and a sub-unit 606 (in this example) includes 25 twisted pairs of conductors. In accordance with conventional techniques, each sub-unit 606 may be twisted for purposes of structural integrity and/or to enhance electrical characteristics. Sub-unit binding machine 604 can simultaneously form a plurality of sub-units 606, e.g., four 25-pair sub-units 606.

The sub-units 606 are appropriately advanced from sub-unit binding machine 604 to a unit binding machine 608 (step 220). In this example, units 610 are assembled from four sub-units 606 (step 230). When unit 610 is assembled, first colored ribbon 500 (see FIG. 5) is wrapped around unit 610 as unit 610 progresses through the unit binding machine 608 (step 240). The first colored ribbon is preferably wrapped around the unit continuously in a spiral manner, so that there is a relatively constant amount of space between two adjacent wraps of the same colored ribbon (i.e., the ribbon has a substantially uniform twist length). After the first colored ribbon is applied to the unit, the initially-identified unit 610 is collected on a unit truck 612 (step 250). Unit truck 612 may be a large spool used for holding the initially-identified unit 610 that is produced during the stranding phase. Rotation of unit truck 612 causes the unit 610, the sub-units 606, and the conductors 600 to be drawn through the stranding equipment.

In a practical embodiment, the first colored ribbon may represent the layer of the unit within the twisted pair exchange cable. Any number of colors may be used for the ribbons, however, in a preferred embodiment, yellow or black is used for the first colored ribbon. Referring back to FIG. 1, the units of the innermost layer will have a yellow ribbon, the units of the next layer that is immediately adjacent will have a black ribbon, and the units of the remaining layers will alternate with yellow and black ribbons. Thus, in a preferred embodiment, only two different color coded units are produced—yellow and black. As it will be readily appreciated, this greatly simplifies the manufacturing process.

After the stranding phase is completed (or when unit truck 612 reaches its capacity), unit trucks 612 holding initially-identified units 610 are transported to the machines used for the cabling phase. In a typical factory layout, unit trucks 612 may be transported over a hundred feet from the stranding area to the cabling area. As described above, some of the units will be wrapped in a yellow ribbon, and some of the units will be wrapped in a black ribbon. As depicted by the ellipses in FIG. 6, the cabling phase may gather initially-identified units 610 from any number of separate unit trucks 612. During the cabling phase, initially-identified units 610 are fed from their respective source unit trucks 612.

A binding machine 614 according to the current invention is used to apply the second colored ribbon to each unit during the cabling phase. Binding machine 614 can simultaneously process a plurality of units. Thus, binding machine 614 can receive input from a plurality of supply means such as a plurality of unit trucks 612. Also, two or more binding machines can be used simultaneously to produce one twisted pair exchange cable. This is done in order to reduce the burden on each binding machine. When unit trucks 612 are staged at binding machine 614, the units 610 on each unit truck 612 are strung through binding machine 614. Preferably, binding machine 614 includes a plate 310 that has multiple openings or guide-holes 320 (see FIG. 3) so that multiple units can pass through it. Each unit 610 is strung from the source unit truck 612 through its respective guide-hole in the plate of new binding machine 614. Each guide-hole may be labeled with an index number that identifies the source unit truck for the unit passing through that opening. The index number can be used to identify the orientation of the unit in the configuration of the final twisted pair exchange cable.

Referring again to FIGS. 2 and 6, units 610 are advanced from unit trucks 612 through binding machine 614 (step 260). At the cabling operation, the operator loads the proper colored ribbon on each binder spindle 330 (see FIG. 3). The operator then pulls each unit 610 by hand through binder 614 into cabling machine 616, where the new units are tied into the remnants of the previous cable (if one is present). At binding machine 614, second colored ribbon 510 is wrapped around each initially-identified unit 610 (step 270). The second colored ribbon is preferably wrapped around each unit continuously in a spiral manner and adjacent to the first colored ribbon. After the second colored ribbon is applied to the units, a respective number of finally-identified units 615 are produced. Thereafter, twisted pair exchange cable 620 is assembled from the plurality of finally-identified units 615 at cabling machine 616 (step 280) and collected on a spool 618.

In the practical embodiment described herein, the second colored ribbon represents the orientation of the unit within a layer of units in the twisted pair exchange cable. Any number of colors may be used for the ribbons, however, in the exemplary embodiment, green, red and blue are used for the second colored ribbon.

Since only two different color coded units are input to the cabling phase of the current invention, it becomes easier and more economic to fill short orders. It will be readily appreciated that twisted pair exchange cables with different unit configurations can now be filled from the same source units. Since the second colored ribbon is now applied during the cabling phase, the same unit can now appear in a different position in different cables. Stated another way, in one cable a yellow ribboned unit may also be wrapped with a green ribbon, and in another cable the same yellow ribboned unit may also be wrapped with a red ribbon. Thus, the units will not have to be switched out prior to the cabling phase; the units can remain loaded in binding machine 614, and a different colored second ribbon can be applied to it. The time spent in unloading units 610, and loading and restringing other units 610 will now be saved. Also, it will be possible to avoid discarding units that are used to fill short orders, as the same units 610 can now be used to fill multiple short orders.

The present invention provides for an improved process and apparatus for manufacturing twisted pair exchange cables. As will be readily appreciated, in light of this disclosure, a long-felt need is solved. Stated another way, the present invention provides for a method and apparatus that reduces complexity, saves money, and allows for short orders of cables to be filled economically.

Figure 3:
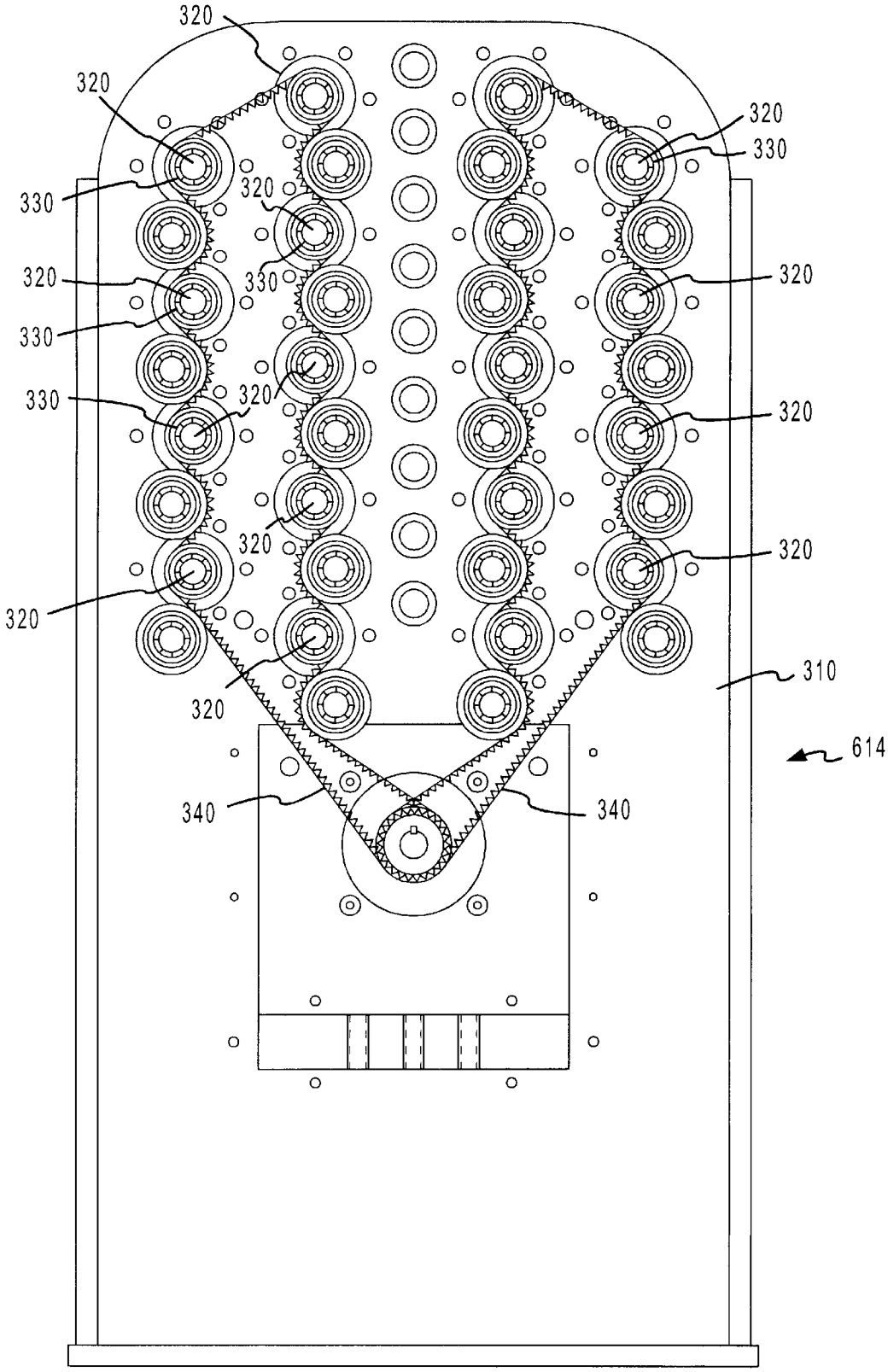
FIG. 3 is a back sectional view of an exemplary binding machine.
Figure 4:
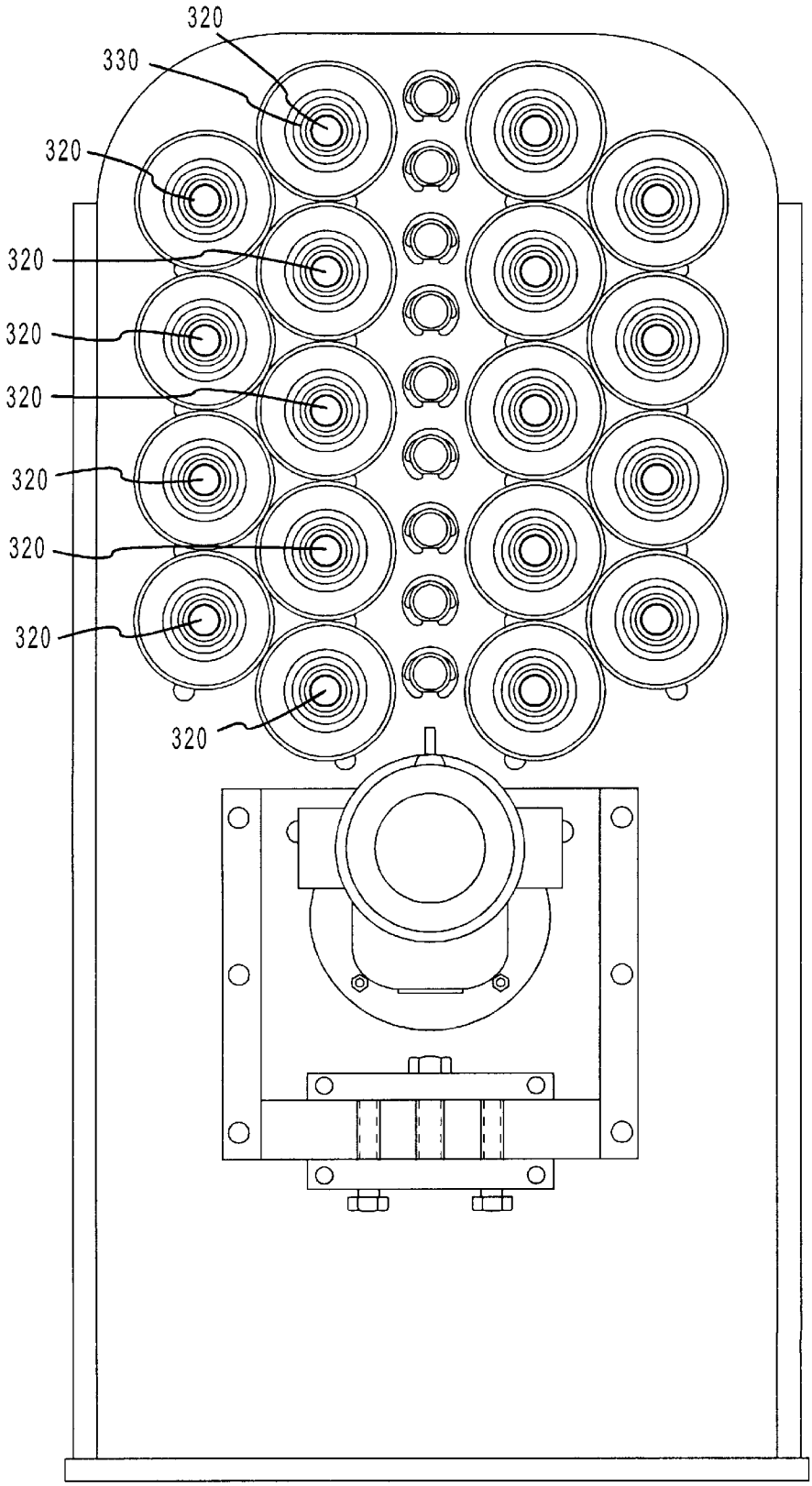
FIG. 4 is a front sectional view of an exemplary binding machine.

The binding machine 614 of the present invention is used for the cabling phase of the manufacturing of twisted pair exchange cables. More than one binding machine 614 can be used simultaneously in order to manufacture a twisted pair exchange cable. As described above, binding machine 614 preferably receives initially-identified units 610 from source unit trucks 612. Alternatively, spools of units, or other similar supply means can be used to supply binding machine 614. Binding machine 614 is capable of processing multiple units 610 at the same time. For example, referring to FIG. 3, a back view of a preferred embodiment of new binding machine 614 is illustrated (in this context, the back side of binding machine 614 is the input side and the front side is the output side). Binding machine 614 preferably has a plate 310 with a plurality of guide-holes 320, and a plurality of spindles 330. The plurality of guide-holes 320 guide units 610, and the spindles act as a mount for the spools of ribbon. Each unit 610 will pass through a respective guide-hole 320. Each guide-hole 320 may be labeled so as to identify the source unit truck 612 for that guide-hole 320. Spindles 330 are furnished with a spool of colored ribbon so that each spindle 330 is associated with a colored ribbon that is applied to a unit 610. Each spindle 330 is preferably associated with a guide-hole 320 so that spindle 330 will apply the colored ribbon around unit 610 passing through its associated guide-hole 320. The plurality of spindles 330 preferably rotate at equal speed so that the ribbons are applied at the same rate. Furthermore, the rotation of spindles 330 is substantially constant to facilitate a certain twist length. The ribbon is applied to unit 610 at a rate that can be set by the rotation of spindle 330 relative to unit 610, rotation of unit 610 relative to spindle 330, or a combination of both. Binding machine 614 is preferably configured with one or more drive belts 340 that rotate spindles 330. As shown in FIG. 3, binding machine 614 employs drive belts 340 and a particular arrangement of spindles 330 such that each drive belt 340 is capable of driving more than two, e.g., nine, spindles 330.

Figure 7:
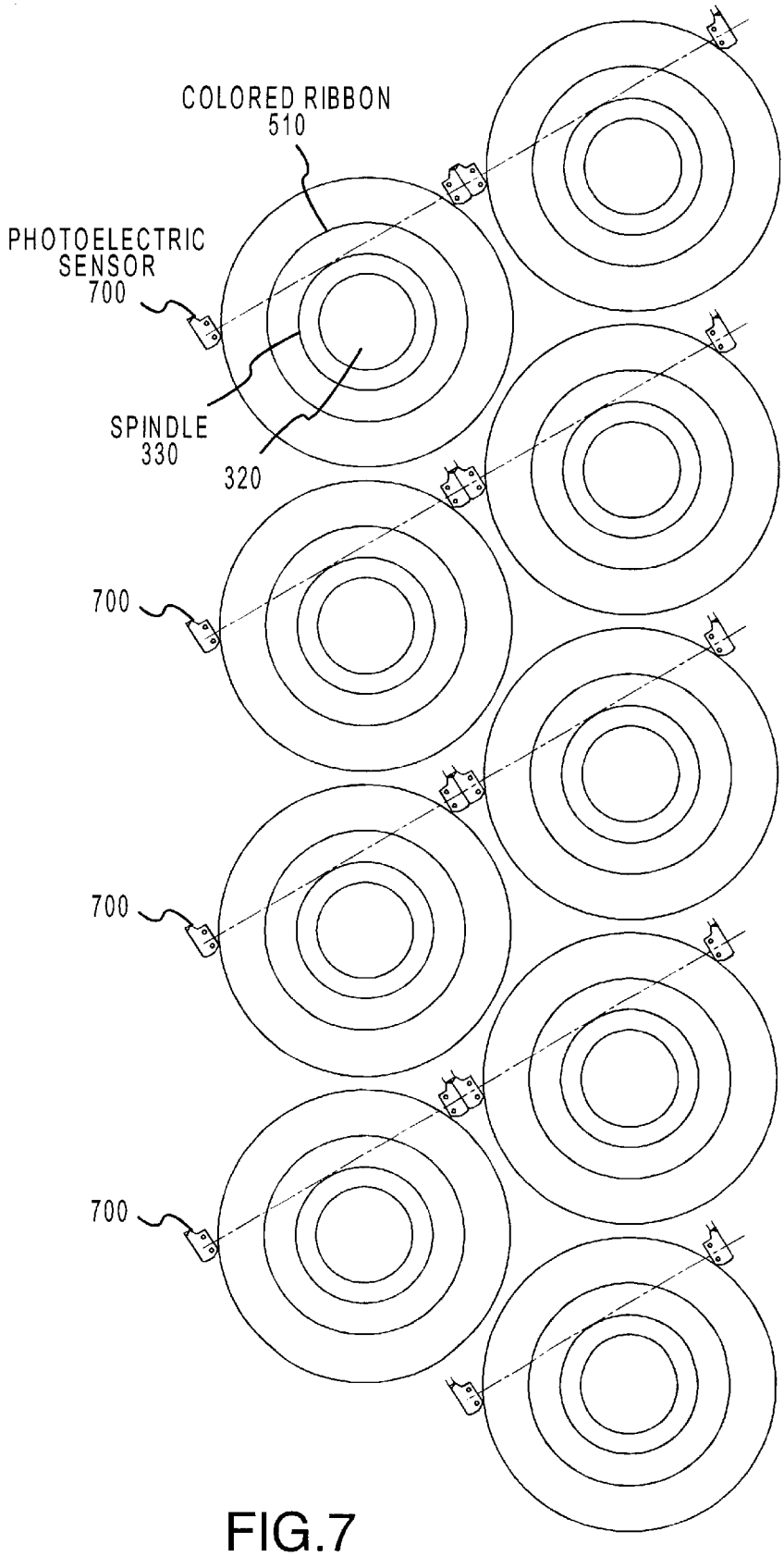
FIG. 7 is a front sectional view of a portion of the binding machine of FIG. 4.

Referring to FIG. 7, binding machine 614 may include a plurality of photoelectric sensors 700 that are attached to spindles 330. Preferably, there is one sensor 700 per spindle 330, and the sensor is used to detect and shut down the cabling line when a colored ribbon breaks or runs out.

Although the present invention has been described in conjunction with particular embodiments illustrated in the appended drawing figures, various modification may be made without departing from the spirit and scope of the invention as set forth in the appended claims. For example, different color ribbons may be used, or different size cables may be produced. These and other modifications of the preferred embodiment are intended to be within the scope of the following claims.

What is claimed is:

1. A method of producing a multiconductor communications cable, said method comprising the steps of:

(a) applying a first identification ribbon around each of a plurality of units to thereby obtain a respective plurality of initially identified units;

(b) collecting each of said plurality of initially identified units on a respective plurality of unit trucks;

(c) transporting said respective plurality of unit trucks to a cabling station;

(d) advancing each of said plurality of initially identified units from said plurality of unit trucks to a binding machine; and (e) applying, with said binding machine, a second identification ribbon around each of said plurality of initially-identified units, to thereby obtain a respective plurality of finally identified units.

2. The method of producing a communications cable recited in claim 1, wherein said step (e) is performed with said binding machine, which comprises:

a plate having a plurality of guide-holes, each of said guide-holes adapted to receive one of said initially identified units; and a plurality of spindles, each of said plurality of spindles adapted to apply said second identification ribbon around one of said initially identified units.

3. The method of producing a communications cable recited in claim 1, wherein said method further comprises the steps of:

(f) advancing a plurality of conductors from a first plurality of reels to a sub-unit binding machine;

(g) forming a plurality of twisted pair conductors;

(h) assembling a plurality of sub-units, each of said sub-units including a number of said plurality of twisted pairs;

(i) advancing said plurality of subunits from said sub-unit binding machine to a unit binding machine;

(j) assembling said plurality of units, each of said units including a number of said plurality of sub-units; and (k) assembling said communications cable from said plurality of finally identified units.

4. The method of producing a communications cable recited in claim 3, wherein:

each of said plurality of sub-units comprises at least 25 twisted pairs;

each of said plurality of units comprises at least 100 twisted pairs; and said communications cable comprises at least 600 twisted pairs.

5. The method of producing a communications cable recited in claim 1, wherein said first identification ribbon represents the layer of said finally identified unit within said communications cable.

6. The method of producing a communications cable recited in claim 1, wherein said second identification ribbon represents the position of said finally identified unit within a layer of said communications cable.

7. The method of producing a communications cable recited in claim 1, wherein:

said step (a) is performed so that said first identification ribbon is wound at a substantially regular interval along each of said plurality of units; and said step (e) is performed so that said second identification ribbon is wound at a substantially regular interval along each of said plurality of initially identified units.

8. The method of producing a communications cable recited in claim 7, wherein said step (e) is performed so that said second identification ribbon is wound adjacent to said first identification ribbon.

9. A method according to claim 1, wherein said first and second identification ribbons are color-coded.

10. A method of producing a multiconductor communications cable, said method comprising the steps of:

(a) forming a plurality of twisted pair conductors;

(b) assembling a plurality of sub-units, each of said sub-units including a number of said plurality of twisted pair conductors;

(c) assembling a plurality of units, each of said units including a number of said plurality of sub-units;

(d) applying a first identification ribbon around each of said plurality of units to thereby obtain a respective plurality of initially identified units;

(e) collecting each of said plurality of initially identified units on a respective plurality of unit trucks;

(f) advancing each of said plurality of initially identified units from said plurality of unit trucks to a binding machine;

(g) applying, with said binding machine, a second identification ribbon around each of said plurality of initially identified units to thereby obtain a respective plurality of finally identified units; and (h) assembling said communications cable from said plurality of finally identified units.

11. The method of producing a communications cable recited in claim 10, wherein said first identification ribbon represents the layer of said finally identified unit within said communications cable.

12. The method of producing a communications cable recited in claim 10, wherein said second identification ribbon represents the position of said finally identified unit within a layer of said communications cable.

13. The method of producing a communications cable recited in claim 10, wherein:

said step (d) is performed so that said first identification ribbon is wound at a substantially regular interval along each of said plurality of units; and said step (g) is performed so that said second identification ribbon is wound at a substantially regular interval along each of said plurality of initially identified units.

14. A method according to claim 10, wherein said first and second identification ribbons are color-coded.

15. A binding machine for assembling a multiconductor communications cable from a plurality of units comprising:

supply means for supplying said plurality of units;

a plate having a plurality of guide-holes, each of said guide-holes being configured to receive one of said units;

a plurality of spindles, each of said plurality of spindles being configured to wind an identification ribbon around one of said units; and a plurality of drive belts engaging said plurality of spindles, said drive belts rotating said plurality of spindles.

16. The binding machine of claim 15 wherein each of said drive belts engages at least nine of said spindles.

17. The binding machine of claim 15, wherein said plurality of drive belts rotate said plurality of spindles at substantially the same rate.

18. The binding machine of claim 15, further comprising a plurality of ribbon spools, each of said plurality of ribbon spools being coupled to a respective one of said plurality of spindles.

19. The binding machine of claim 18, further comprising a plurality of photoelectric sensors, each of said sensors being associated with a respective one of said plurality of spindles, each of said sensors being configured to detect when said ribbon spools run out of ribbon.

20. The binding machine of claim 15, wherein the positioning of said guide-holes and the positioning of said spindles are associated with the configuration of said plurality of units within said communications cable relative to each other.

* * * * *